US008913772B2

(12) United States Patent
Yamaguchi et al.

(10) Patent No.: US 8,913,772 B2
(45) Date of Patent: Dec. 16, 2014

(54) EAR SPEAKER DEVICE

(75) Inventors: Yukimasa Yamaguchi, Tokyo (JP); Makoto Yamagishi, Tokyo (JP); Satoshi Suzuki, Kanagawa (JP)

(73) Assignee: Sony Corporation, Tokyo (JP)

( * ) Notice: Subject to any disclaimer, the term of this patent is extended or adjusted under 35 U.S.C. 154(b) by 1520 days.

(21) Appl. No.: 12/194,420

(22) Filed: Aug. 19, 2008

(65) Prior Publication Data

US 2009/0052716 A1 Feb. 26, 2009
US 2014/0254855 A9 Sep. 11, 2014

Related U.S. Application Data

(63) Continuation-in-part of application No. 11/910,321, filed as application No. PCT/JP2007/052164 on Feb. 1, 2007, now Pat. No. 8,213,632.

(30) Foreign Application Priority Data

Feb. 1, 2006 (JP) ..... 2006-024957
Dec. 5, 2006 (JP) ..... 2006-328603
Aug. 24, 2007 (JP) ..... 2007-219090

(51) Int. Cl.
*H04R 25/00* (2006.01)
*H04R 1/10* (2006.01)
*H04R 5/033* (2006.01)
*H04R 1/28* (2006.01)

(52) U.S. Cl.
CPC ..... *H04R 1/1058* (2013.01); *H04R 1/1066* (2013.01); *H04R 5/0335* (2013.01); *H04R 1/2819* (2013.01)
USPC ..... 381/370; 381/378; 381/380; 381/382

(58) Field of Classification Search
None
See application file for complete search history.

(56) References Cited

U.S. PATENT DOCUMENTS

| | | | | |
|---|---|---|---|---|
| 6,707,924 | B1 * | 3/2004 | Okiebisu | 381/385 |
| 2009/0052716 | A1 * | 2/2009 | Yamaguchi et al. | 381/378 |
| 2009/0154755 | A1 * | 6/2009 | Yamagishi et al. | 381/382 |
| 2009/0260134 | A1 * | 10/2009 | Wittmann-Price et al. | 2/423 |
| 2010/0166204 | A1 * | 7/2010 | Yanagishita et al. | 381/71.6 |
| 2010/0201938 | A1 * | 8/2010 | Jackson et al. | 351/158 |
| 2011/0170054 | A1 * | 7/2011 | Jackson et al. | 351/158 |

FOREIGN PATENT DOCUMENTS

| | | |
|---|---|---|
| JP | 10-191491 | 7/1998 |
| JP | 2000-295685 | 10/2000 |
| JP | 2002-095085 | 3/2002 |
| JP | 2005-295462 | 10/2005 |
| WO | WO 2007/089033 | 8/2007 |

* cited by examiner

*Primary Examiner* — Marlon Fletcher
(74) *Attorney, Agent, or Firm* — Sony Corporation

(57) ABSTRACT

The ear speaker device includes a mount section that is provided with ear-hook sections, and rotation sections that rotate speaker movable sections with respect to the mount section. Tubular ducts are positioned more inside than the ear-hook sections in a natural state. When the ear speaker device is mounted, the speaker movable sections are rotated to the most outside positions. Then, the ear-hook sections are brought into contact with auricle base upper sections, respectively, and the speaker movable sections are rotated inwardly. In this manner, the tubular ducts can be positioned in the vicinity of the external acoustic meatus openings, respectively, of the listener without interfering with auricles and the like.

15 Claims, 13 Drawing Sheets

EAR SPEAKER DEVICE

CROSS REFERENCES TO RELATED APPLICATIONS

The present application is a continuation-in-part of U.S. patent application Ser. No. 11/910,321 filed on Oct. 1, 2007, which makes reference to, claims priority to and claims benefit from PCT International Application PCT/JP2007/052164 filed on Feb. 1, 2007, which makes reference to, claims priority to and claims benefit from Japanese Priority Patent Application JP2006-024957 filed in the Japan Patent Office on Feb. 1, 2006 and Japanese Priority Patent Application JP 2006-328603 filed in the Japan Patent Office on Dec. 5, 2006. The present invention contains subject matter related to Japanese Patent Application JP2007-219090 filed in the Japanese Patent Office on Aug. 24, 2007, the entire contents of which being incorporated herein by reference.

BACKGROUND OF THE INVENTION

1. Field of the Invention

The present invention relates to an ear speaker device, and is suitably applied to, for example, an ear speaker device that mounts a speaker on the head of a listener.

2. Description of the Related Art

As a known headphone device having a structure that is close to a head mount type ear speaker device, one that converts an electric signal representing reproducing sound of a compact disc (CD) to a sound (hereinafter referred to as reproduction sound) in a state where the headphone device is mounted on the head of a listener so as to allow the listener to listen to the reproduction sound has been widely used.

A generally-used headphone device positions a speaker unit that generates-sound at a location near the front of an opening of the external acoustic meatus of the listener. In this manner, the headphone device allows sound to reach directly to the eardrum from the speaker unit. For this reason, while the headphone device can improve sound quality, the headphone device localizes a sound image in the head of the listener. Accordingly, the headphone device has given the listener an unnatural impression.

For the above reason, there has been suggested an ear speaker device as a headphone device (for example, refer to Jpn. Pat. Appln. Laid-Open Publication No. 2000-295685 [FIG. 1]). In this ear speaker device, the speaker unit is somewhat separated from an opening (an ear hole) of the external acoustic meatus and positioned on the front side of the head. In this manner, a sound image is localized outside the head as in a case of using a generally-used floor type speaker, an unnatural feeling is eliminated.

SUMMARY OF THE INVENTION

However, the ear speaker device of the above structure has the speaker unit separated from the ear hole. Also, the surrounding space is open and thus low frequency sound of the reproduction sound is not sufficient. Accordingly, there has been a problem that sound quality is deteriorated. In addition, the headphone device is preferably easy to be mounted on and dismounted from the head of the listener.

The present invention has been made in view of the above, and proposes an ear speaker device that can allow the listener to listen to the high quality reproduction sound that provides natural sound image localization and includes sufficient low pitch sound, and also can be easily mounted on and dismounted from the head.

In order to achieve the above, according to an aspect of the present invention, there is provided an ear speaker device that includes a mount section, left and right speaker sections, left and right support sections, left and right tubular ducts. The mount section is mounted on the head of a listener in a manner contacting an upper part of the head and auricle base upper sections on the left and right and sandwiching the head from the left and right. The left and right speaker sections include a hollow enclosure to which a speaker unit is attached. The left and right support sections are attached to the mount section and support the speaker sections so as to position sound emission surfaces of the speaker units in front of openings of external acoustic meatuses of the listener. The left and right tubular ducts are attached to the enclosures and extended so as to allow sound generated in the enclosures to reach the vicinity of the openings of the external acoustic meatuses. The support sections temporarily position the speaker units more outside than the mount section when force in outward directions on the left and right is applied to the support sections, and position the speaker units in front of the openings of the external acoustic meatuses with respect to the mount section when the force in outward directions is released.

In the above manner, when the ear speaker device is mounted on or dismounted from the head of the listener, the speaker sections can be temporarily moved in outward directions so as to prevent interference with the auricles and the like. At the same time, when the ear speaker device is mounted on the head, the sound emission surfaces of the speaker units are positioned in front of the openings of the external acoustic meatuses so as to allow end sections of the tubular ducts to reach positions in the vicinity of the openings of the external acoustic meatuses.

According to the aspect of the present invention, when the ear speaker device is mounted on or dismounted from the head of the listener, the speaker sections can be temporarily moved in outward directions so as to prevent interference with the auricles and the like. At the same time, when the ear speaker device is mounted on the head, the sound emission surfaces of the speaker units are positioned in front of the openings of the external acoustic meatuses so as to allow end sections of the tubular ducts to reach positions in the vicinity of the openings of the external acoustic meatuses. In this manner, the ear speaker device that can provide natural sound image localization and allow the listener to listen to the reproduction sound of high quality including sufficient low frequency sound, and, at the same time, can be mounted on or dismounted from the head by easy operation is realized.

The nature, principle and utility of the invention will become more apparent from the following detailed description when read in conjunction with the accompanying drawings in which like parts are designated by like reference numerals or characters.

DETAILED DESCRIPTION OF THE PREFERRED EMBODIMENTS

Hereinafter, an embodiment of the present invention will be described in detail with respect to the accompanying drawings.

(1) Structure of Ear Speaker Device

Figure 1:
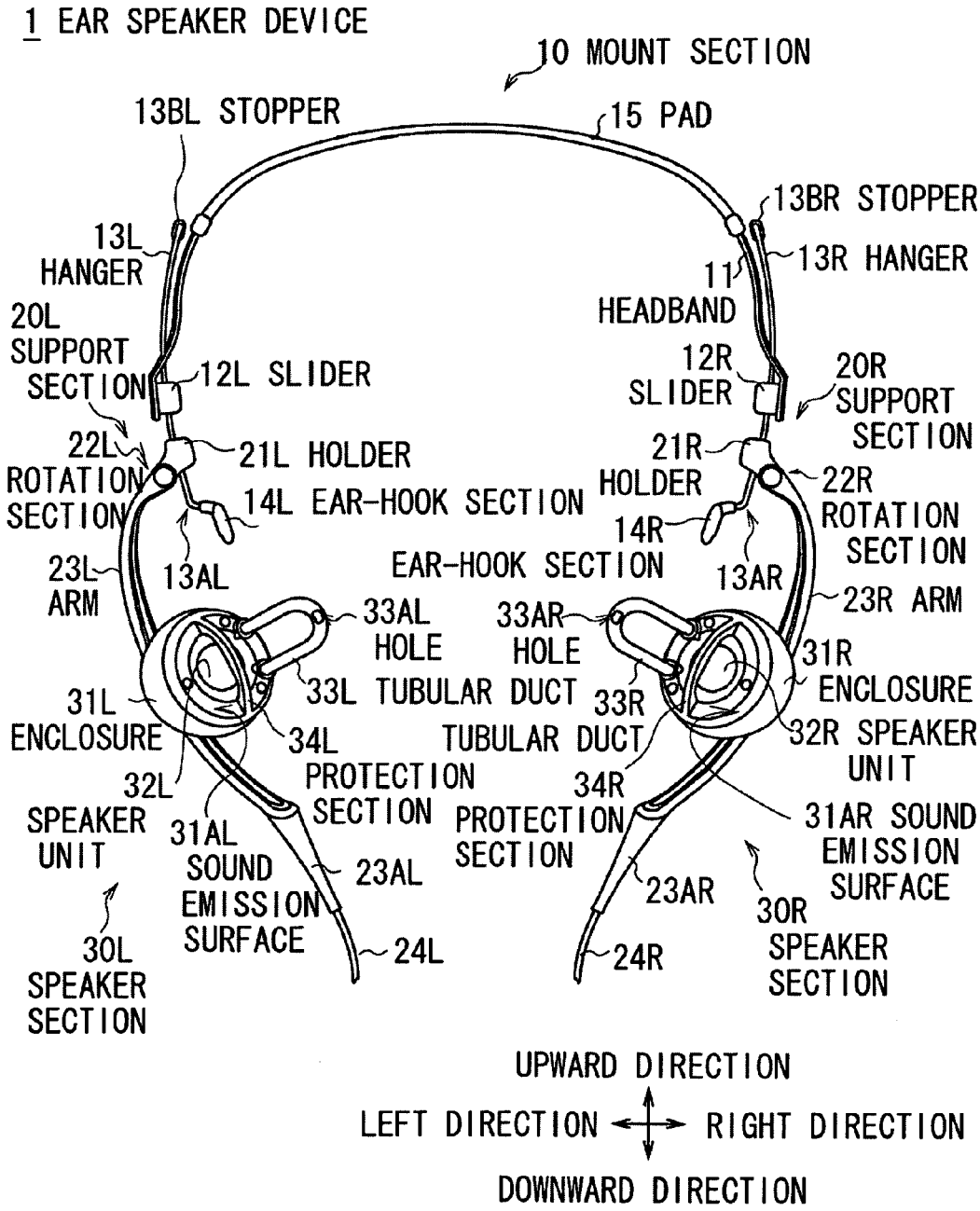
FIG. 1 is a schematic front view showing an entire structure (1) of an ear speaker device.
Figure 2:
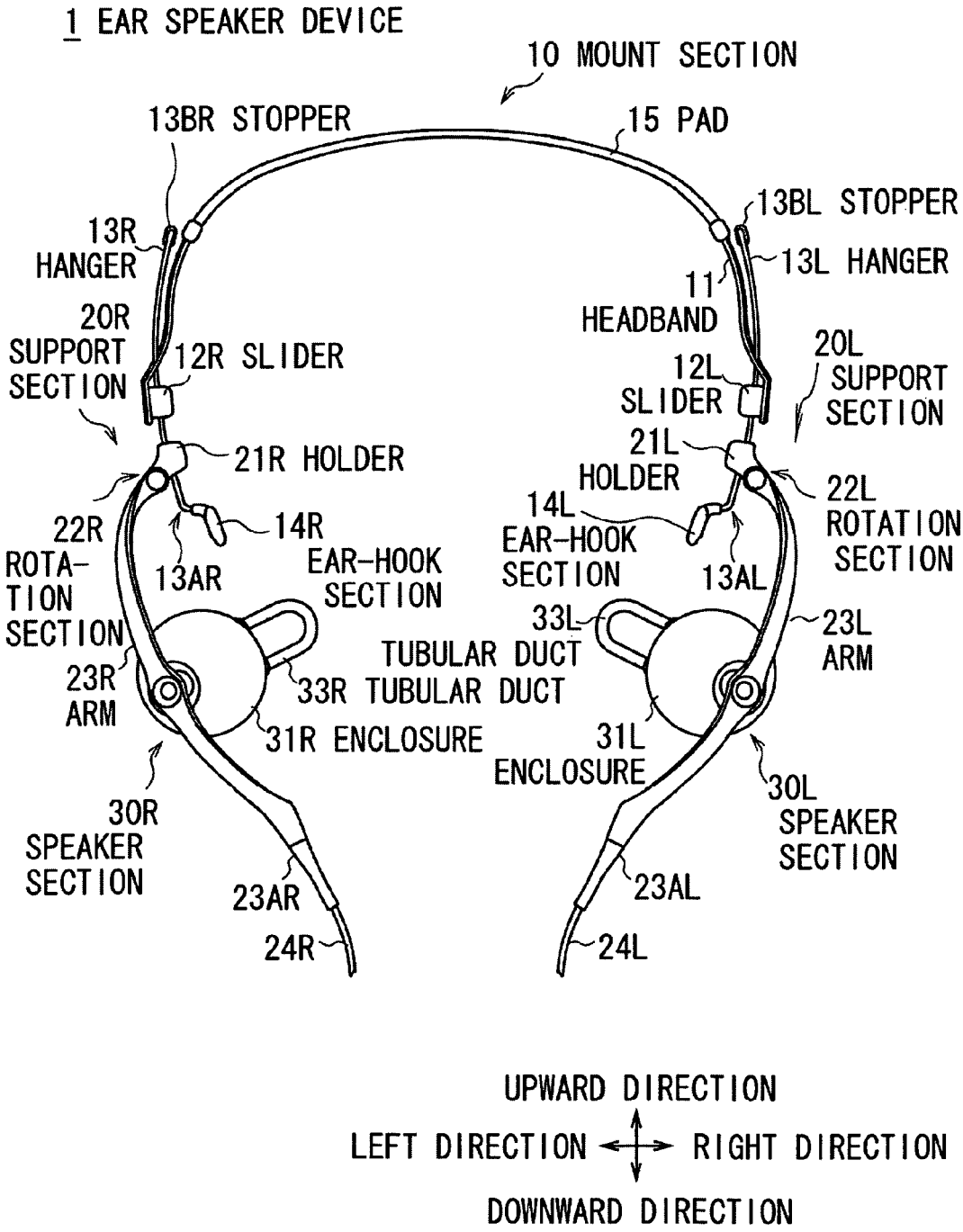
FIG. 2 is a schematic rear view showing an entire structure (2) of the ear speaker device.
Figure 3:
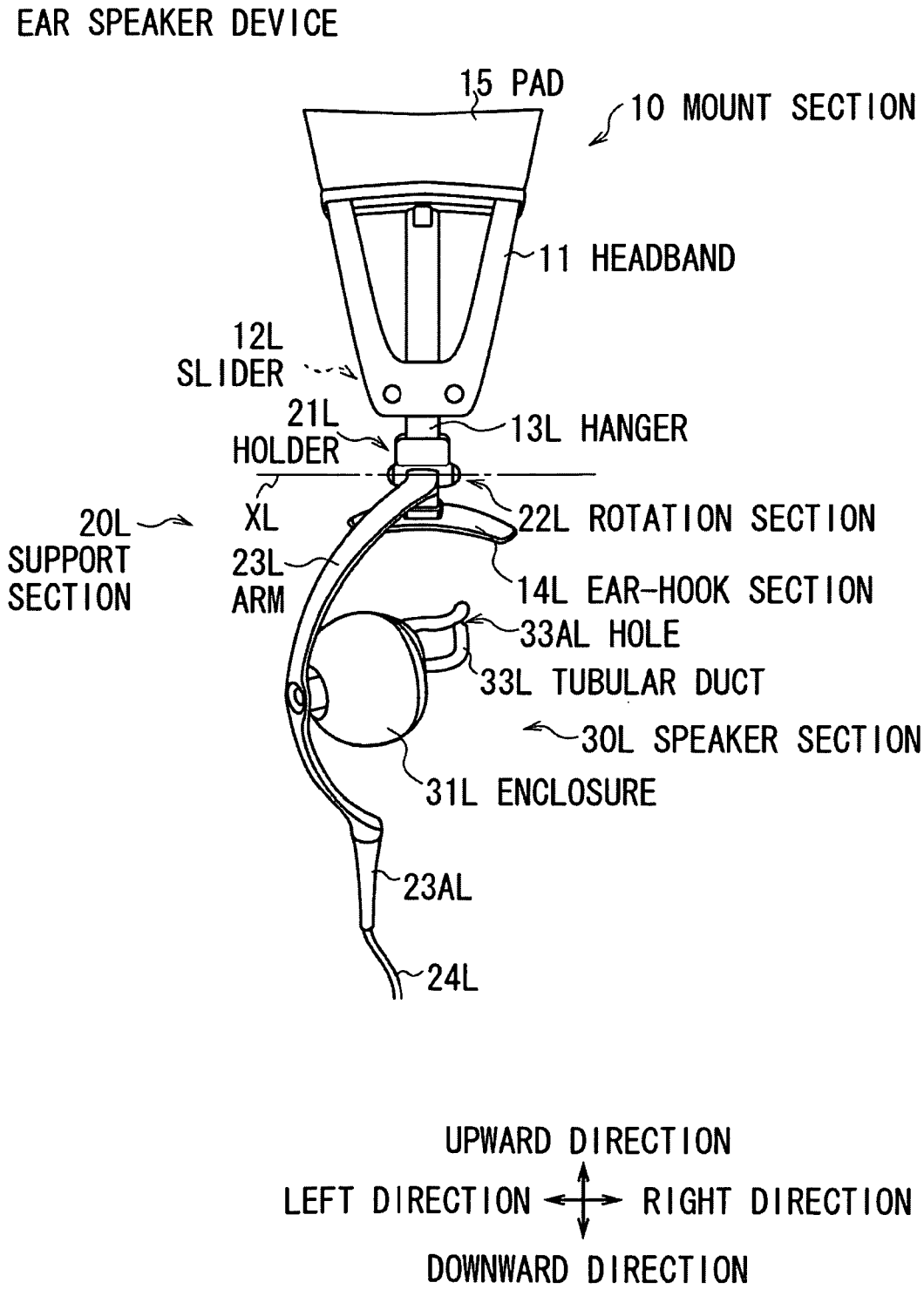
FIG. 3 is a schematic left side view showing an entire structure (3) of the ear speaker device.

In FIGS. 1, 2, and 3, an ear speaker device 1 converts an electric signal generated by reproduction processing and the like of a portable compact disc (CD) player and a digital music player (DMP) to sound, and allows a listener to listen to such sound.

Unlike a general box speaker device, the ear speaker device 1 is assumed to be mounted on the head of the listener like a headphone device. In actuality, the ear speaker device 1 roughly includes a mount section 10, left and right speaker sections 30L and 30R, and support sections 20L and 20R. The mount section 10 is used for mounting the ear speaker device 1 on the head of the listener in a stable manner. The speaker sections 30L and 30R convert an electric signal to sound (hereinafter referred to as reproduction sound). The support sections 20L and 20R are attached to the left and right of the mount section 10 and support the speaker sections 30L and 30R, respectively.

Hereinafter, description will be made by defining an upward direction, a downward direction, a right direction, a left direction, a forward direction, and a backward direction when the ear speaker device 1 is mounted on the listener's head.

(1-1) Structure of Mount Section

The mount section 10 includes a headband 11 that covers an upper part of the head of the listener as a main member. Hangers 13L and 13R are provided at left and right end sections of the headband 11 with sliders 12L and 12R interposed therebetween.

The headband 11 is formed by a thin metal plate punched out into a substantial elliptical shape and bent in a substantially arc shape. Also, the headband 11 has a shape in which two thin bands that extend from the left to the right of the head of the listener when the ear speaker device 1 is mounted thereon are formed in a manner integrated with a connection section.

In addition, the headband 11 has elasticity as a whole. While the headband 11 is curved to an arc shape that is little smaller than the head of a general listener in a natural state, the headband 11 has a shape that fits an upper part of the head of the listener when the headband 11 is expanded to the left and the right. When the headband 11 is expanded, elastic force of the headband 11 returning to the natural state takes effect.

Further, the center of the headband 11 is covered by a pad 15. In this manner, a feeling of coldness and hardness of metal that can be felt when the ear speaker device 1 is mounted on the head of the listener is reduced.

The ear speaker device 1 has a substantially symmetrical structure as a whole. For this reason, description below will be mainly made with respect to a left side section including reference numerals attached with "L" at the end. Description with respect to a right side section including reference numerals attached with "R" at the end will be omitted.

The slider 12L is attached and fixed to a left end section of the headband 11. The slider 12L includes a hole that is provided in a manner passing through the slider 12L in a vertical direction, and a hanger 13L is threaded through the hole.

The hanger 13L is composed of a thin metal plate of a substantially rectangular shape that is slightly curved to the inside. The hanger 13L is bent to the inside at a bending section 13LA in a lower section, and an ear-hook section 14L is formed at a lower end. In addition, a stopper 13BL is formed at an upper end.

The ear-hook section 14L uses a lower end section of the hanger 13L partially as a core material. A resin material is molded around the core material. The ear-hook section 14L is formed in a crescent shape projecting at a top side. When the ear speaker device 1 is mounted on the head of the listener, a bottom side section and an inner side section of the ear-hook section 14L contact with an auricle base upper section of the listener.

Figure 4:
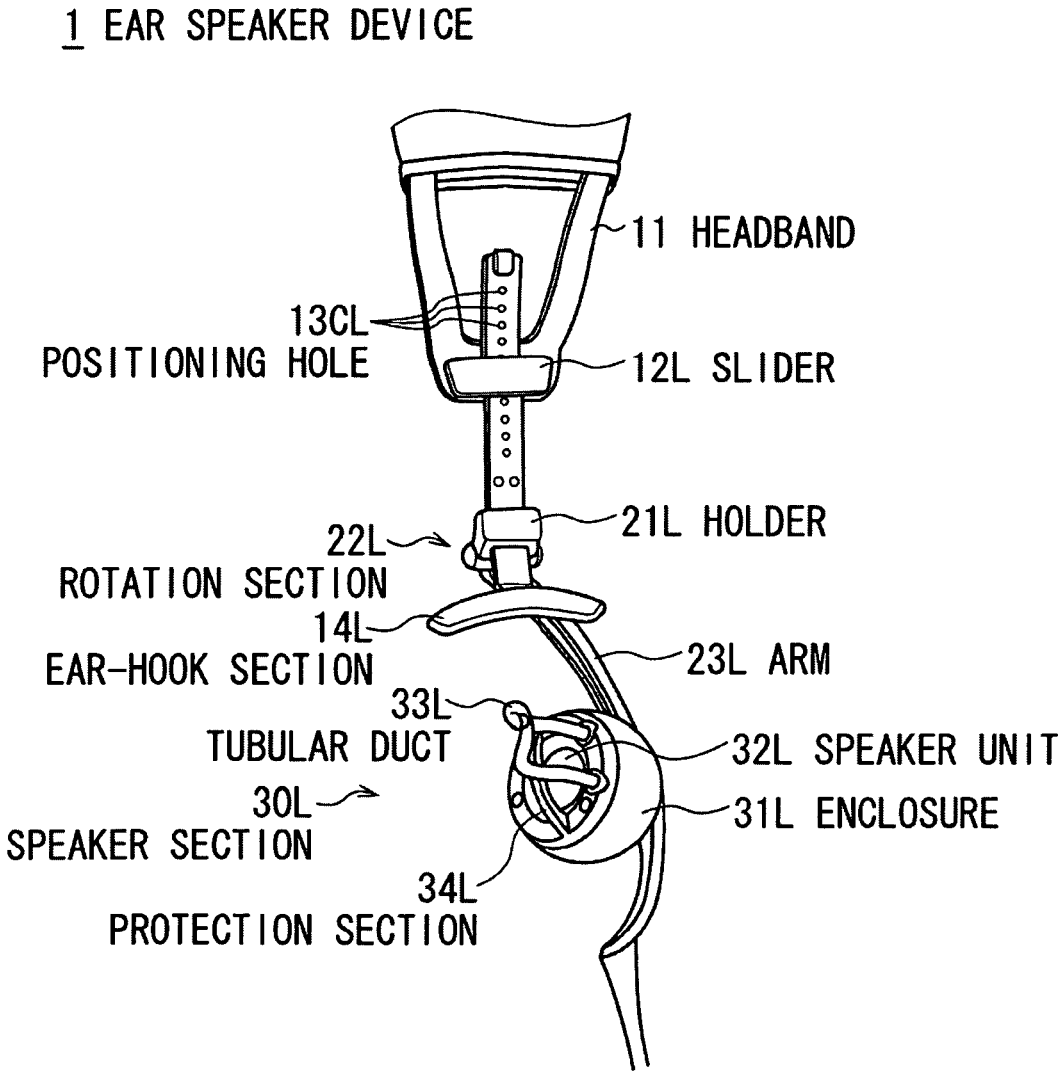
FIG. 4 is a schematic inner surface view showing an entire structure (4) of the ear speaker device.

In addition, ten positioning holes 13CL are formed at substantially regular intervals in a vertical direction on an inner surface of the hanger 13L as shown in FIG. 4. Also, a protrusion section 13DL projecting into the inside is provided at a lower section of the hanger 13L.

On the other hand, the slider 12L sandwiches the hanger 13L at a front side (that is, a left side) and a back side (that is, a right side) of the hanger 13L with certain force in the inside thereof. Further, the ear speaker device 12L is provided with a positioning mechanism (not shown) that corresponds to the positioning holes 13CL.

In the above structure, the slider 12L vertically slides the hanger 13L with respect to the headband 11 by operation of the listener. In this manner, by using the positioning holes 13CL, the slider 12L can allow the listener to select a vertical position of the hanger 13L in a stepwise manner.

In addition, a moving range to an upper side and a lower side of the hanger 13L is restricted by the stopper 13BL and the protrusion section 13DL. Accordingly, the slider 12L can move the hanger 13L in vertical directions in a range of about 40 mm.

In the above manner, the ear speaker device 1 can allow the listener to adjust length (hereinafter referred to as mount section length) of an arc-shape section from the ear-hook section 14L on the left side to an ear-hook section 14R on the right side through the headband 11.

Figure 5:
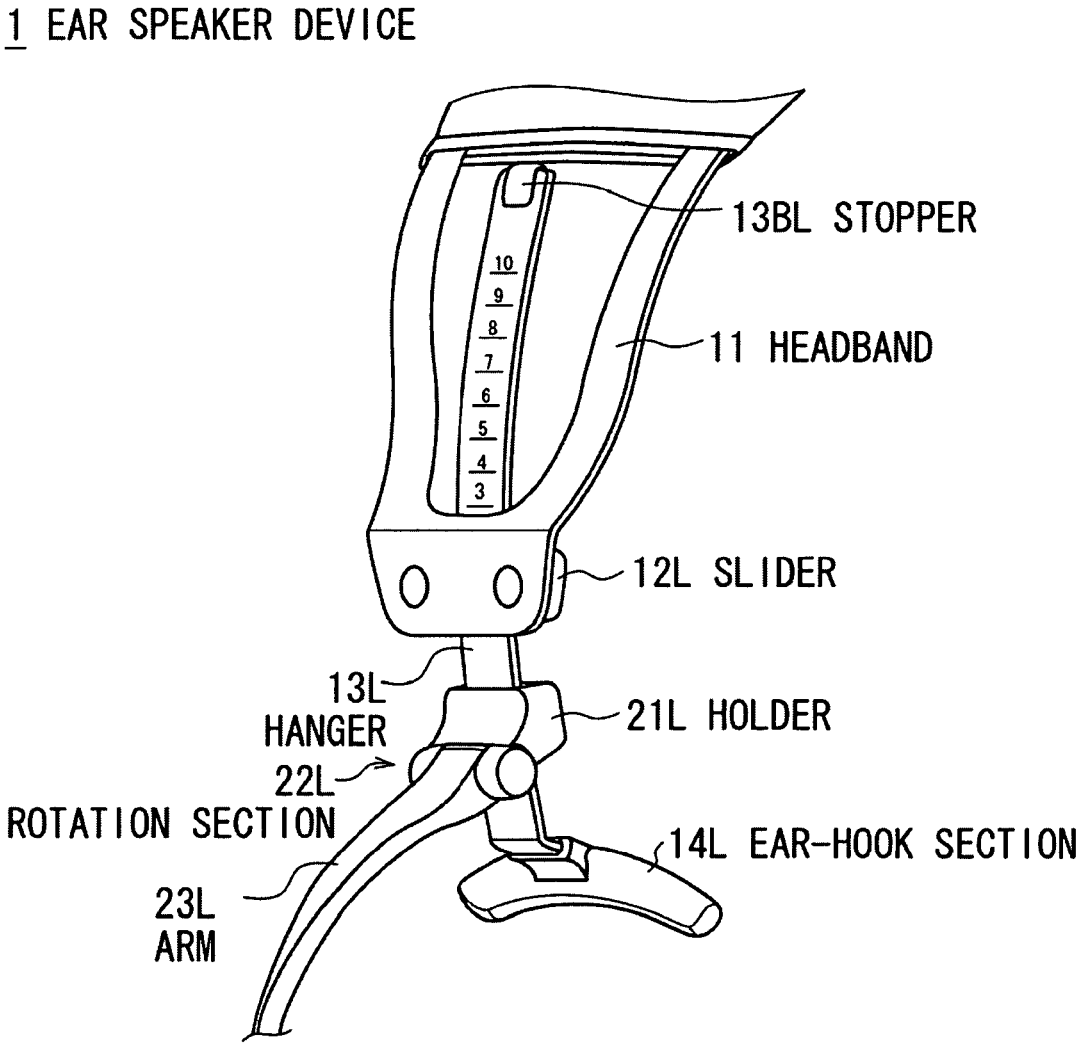
FIG. 5 is a schematic perspective view showing an entire structure (5) of the ear speaker device.

Further, as shown in FIG. 5, an outer surface of the hanger 13L is marked with a scale corresponding to the positioning holes 13CL and numbers from "1" to "10".

For the above reason, the ear speaker device 1 can allow the listener to visually recognize the mount section length by using the scale and the numbers on the hanger 13L, and adjust the mount section length to one desired by the listener with reference to the scale and the numbers.

As described above, the hangers 13L and 13R are slid on the sliders 12L and 12R by operation of the listener. In this manner, the mount section 10 can allow the listener to adjust the mount section length from the left ear-hook section 14L to the right ear-hook section 14R through the headband 11.

(1-2) Structure of Support Section

A support section 20L includes an arm 23L that extends from a holder 21L attached to the hanger 13L with a rotation section 22L provided between the holder 21L and the arm 23L, so that the arm 23L can rotate. Further, a speaker section 30L is attached and fixed to a position that is little lower than a middle in a vertical direction of the arm 23L.

The arm 23L is made of a metal material, and is formed in an arc shape as a whole by injection molding and the like. The arm 23L positions the speaker section 30L forward of the rotation section 22L (that is, the hanger 13L and the like). At the same time, correspondence in design is attempted with the speaker section 30L having a substantial spherical shape and the ear-hook section 14L having a substantial crescent shape. In addition, the arm 23L has predetermined thickness and a predetermined cross-sectional shape, and has strength to an extent that make the arm 23L rarely bend under daily use. Accordingly, the arm 23L can stably hold the speaker section 30L with respect to the mount section 10.

A cap 23AL formed with a soft material such as silicon rubber is attached to a bottom end of the arm 23L. A connection cable 24L is threaded through the center of the cap 23AL. The arm 23L is formed to have a U-shape cross-section. In this manner, the arm 23L sandwiches the connection cable 24L in the inside and guides the connection cable 24L from the cap 23AL to the speaker section 30L.

The holder 21L has a structure partially similar to that of the slider 12L. The holder 21L sandwiches the hanger 13L at a section between the protrusion section 13DL and a bend section 13AL.

For the above reason, the holder 21L can be slid in a vertical direction with respect to the hanger 13L by operation of the listener and the like. In this manner, the holder 21L can allow the listener to adjust a vertical position of the holder 21L with respect to the hanger 13L within a range of about 16 mm between the protrusion section 13DL and the bend section 13AL.

At this time, the holder 21L can adjust space between the ear-hook section 14L and the speaker section 30L, since the speaker section 30L is attached to the holder 21L with the rotation section 22L and the arm 23L interposed therebetween.

In addition, the holder 21L sandwiches the hanger 13L at the front side and at the back side of the hanger 13L with force stronger than that of the slider 12L. Accordingly, when the holder 21L is slid along the hanger 13L, comparatively stronger force is required.

In actuality, the holder 21L presses silicon rubber to the hanger 13L in the inside. With this configuration, holding of a position with respect to the hanger 13L when force to a certain extent is applied, and sliding with respect to the hanger 13L when comparatively strong force is applied are both realized.

For the above reason, the ear speaker device 1 can allow the slider 12L to slide when, for example, the listener holds the headband 11 and the holder 21L and applies force so as to put the headband 11 and the holder 21L closer to or apart from each other, while the holder 21L is fixed with respect to the hanger 13L.

The rotation section 22L includes an outer section of the holder 21L and a top end section of the arm 23L. The rotation section 22L can rotate the arm 23L with respect to the holder 21L within a range of about 35 degrees around a line XL extending in a front-back direction.

In addition, the rotation section 22L includes a coil spring (not shown) in the inside. The coil spring has one side fixed to the holder 21L and the other fixed to the arm 23L. Further, the coil spring constantly biases the arm 23L to an inner side direction with comparatively weak force. FIGS. 1 to 5 show a state in which the arm 23L is biased to the inner side at the most.

For this reason, the rotation section 22L constantly biases the arm 23L and the speaker section 30L (hereinafter the arm 23L and the speaker section 30L are collectively referred to as speaker movable section 25L) in an inner direction (a direction of an arrow a2L) in an integral manner, as shown by a solid line in FIG. 6. On the other hand, when external force to an outward direction is applied to the speaker movable section 25L, the speaker movable section 25L is expanded in the outward direction (a direction of an arrow a1L) in an integral manner, and becomes in a state where the rotation section 22L is rotated to an outer side at the most, as shown by a broken line in FIG. 6.

Figure 6:
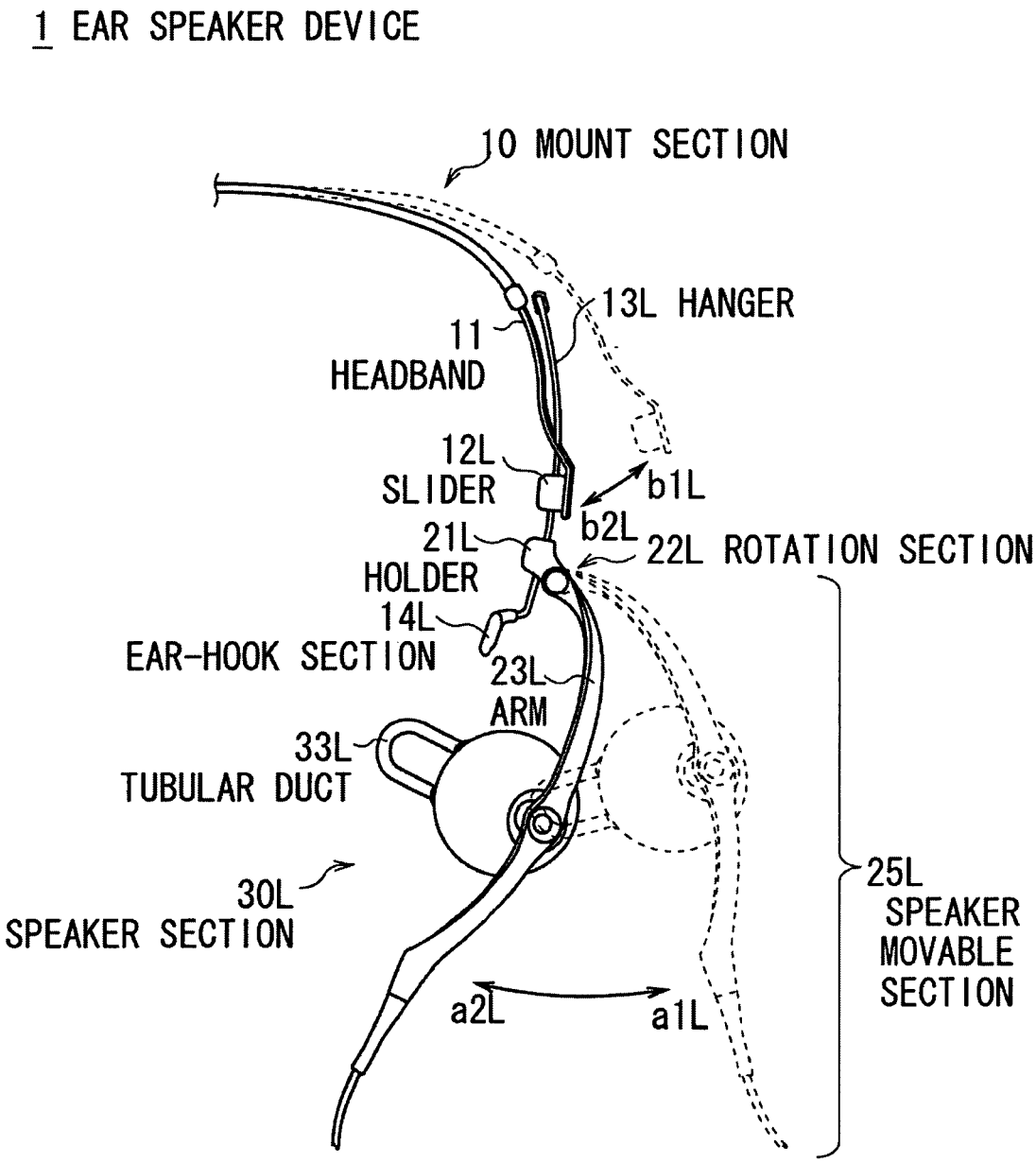
FIG. 6 is a schematic front view used for explaining a movable range of the ear speaker device.

In case force to the outward direction is further applied to the arm 23L and the speaker section 30L in a state where the rotation section 22L is rotated to an outer side at the most, the ear speaker device 1 transmits the external force to the headband 11, and expands the headband 11 in the outward direction (a direction of an arrow b1L) as shown by a broken line in FIG. 6.

As described above, the support section 20L can allow the listener to adjust the space between the ear-hook section 14L and the speaker section 30L by sliding the holder 21L on the hanger 13L. Also, the rotation section 22L constantly biases the speaker movable section 25L in an inward direction, and the arm 23L can be rotated in the outward direction according to the external force.

(1-3) Structure of Speaker Section

The speaker section 30L is mainly composed of a hollow enclosure 31L. The enclosure 31L is molded to have a spherical body and part of which is cut by a plane. A speaker unit 32 is attached to the substantial center of the plane (hereinafter referred to as sound emission surface 31AL). In this manner, the enclosure 31L can operate as an enclosure of the speaker unit 32.

The enclosure 31L is attached to the arm 23L at a section on a side opposite to that of the sound emission surface 31AL with respect to the center of the enclosure 31L.

The speaker unit 32 emits sound by vibrating a diaphragm according to an electric signal supplied from a portable CD player, a DMP, or an amplifier and the like through the connection cable 24.

In addition, a tubular duct 33L made of a hollow member having predetermined thickness bent to have a substantially U-shape on a side is attached to the sound emission surface 31AL of the enclosure 31L in a manner piercing the enclosure 31L. The tubular duct 33L has a rear side thereof bent to an inner direction. Further, a hole 33AL is provided on the substantially center of an inner side end section of the tubular duct 33L.

The tubular duct 33L is made of aluminum and a surface thereof is coated by a predetermined resin. In this manner, a sensible temperature of the tubular duct 33L when directly contacting skin of the listener is increased to about 3 to 5° C., and a feeling of coldness of metal is reduced.

The tubular duct 33L works as a bass reflex duct. In this manner, the entire speaker section 30L operates as a bass-reflex type speaker. The tubular duct 33L has a structure that is substantially equivalent to a structure of two bass reflex ducts of an upper half and a lower half. An inner diameter and an effective length of the tubular duct 33L are determined in consideration of an inner diameter obtained by converting the tubular duct 33L to one tubular duct.

Further, the tubular duct 33L is formed in a substantially U-shape. Accordingly, the tubular duct 33L does not enter the external acoustic meatus of the listener. For this reason, the ear speaker device 1 call prevent the listener from accidentally hurting the external acoustic meatus by the tubular duct 33L when the listener wears the ear speaker device 1.

That is, the tubular duct 33L is formed to have a U-shape on a side thereof. Therefore, an effective length of the tubular duct 33L can be set to shorter as compared with a case when one tubular duct is used. Further, design and safety are significantly improved.

In addition, when the ear speaker device 1 is mounted on the head of the listener, the hole 33AL of the tubular duct 33L is positioned near an opening of the external acoustic meatus of the listener. For this reason, as shown in FIGS. 1 and 2, the tubular duct 33L is positioned in an inner side than the ear-hook section 14L in a natural state in order to correspond to the shape of the ear of the listener.

Further, the sound emission surface 31AL of the enclosure 31L is provided with a protection section 34L for protecting the speaker unit 32L. The protection section 34L includes part of a rim section of a circular plate having an outside diameter that is substantially same as that of the enclosure 31L, and attached to the sound emission surface 31AL almost perpendicularly.

For the above reason, the protection section 34L prevents damage to the speaker unit 32L without blocking the reproduction sound from the speaker unit 32L as much as possible. Further, the protection section 34L provides a feeling of integration with a spherical shape that forms an outer surface of the enclosure 31L.

(2) Mounting of Ear Speaker Device on Listener

Consideration is made so that the tubular duct 33L does not accidentally contact with the head or the auricle of the listener when the ear speaker device 1 is mounted on the head of the listener.

Figure 7A:
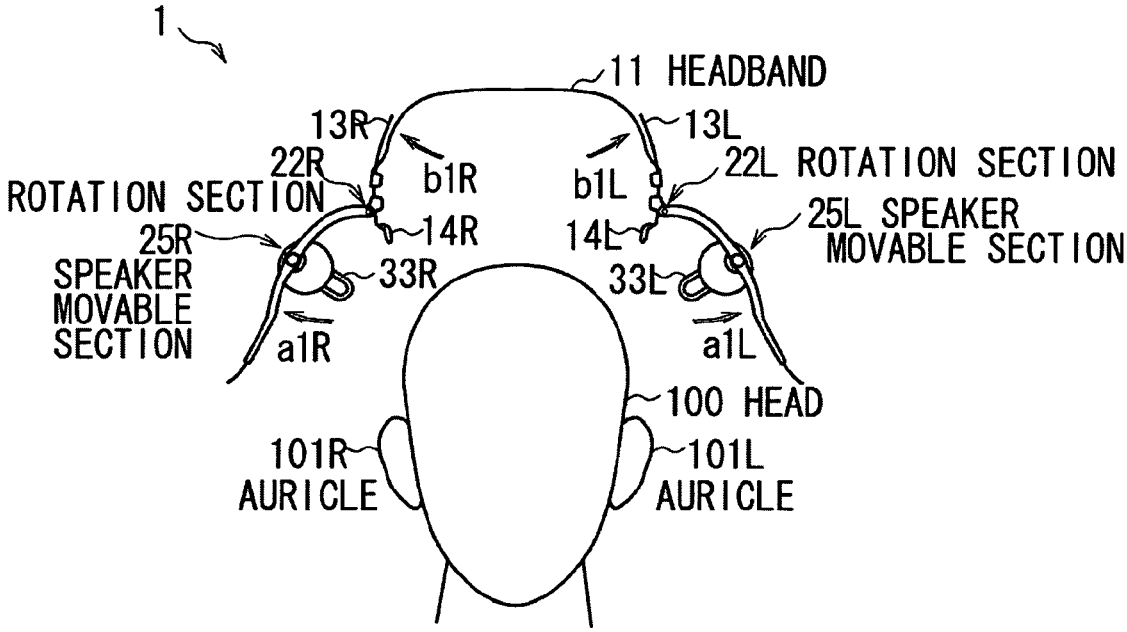
FIGS. 7A and 7B are schematic views used for explaining mounting (1) of the ear speaker device.
Figure 7B:
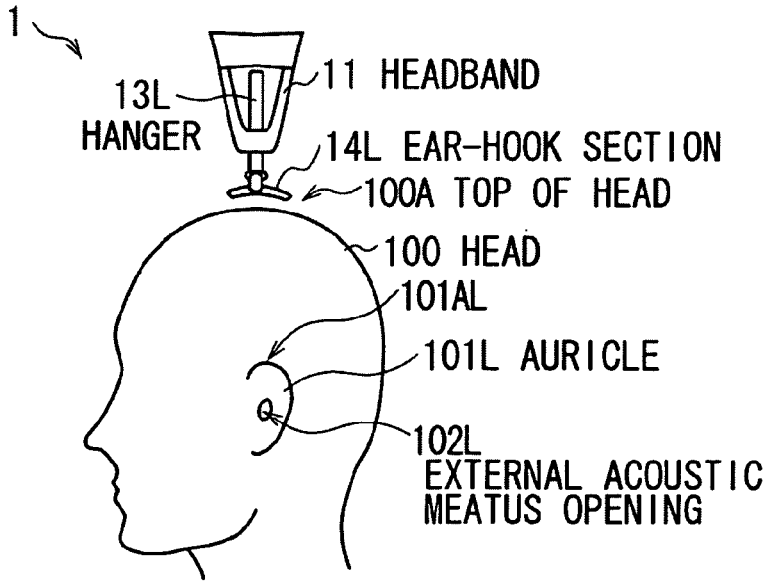

That is, as shown in FIGS. 7A and 7B, the speaker movable sections 25L and 25R are first expanded in outward directions, that is, directions of arrows a1L and a1R while being held by the listener. In this manner, the speaker movable sections 25L and 25R are rotated to most outside positions. Further, the headband 11 is expanded in outward directions, that is, directions of arrows b1L and b1R. In FIG. 7B, the speaker movable section 25L is omitted for convenience of description.

At this time, as shown in FIG. 7A, the ear speaker device 1 has the tubular ducts 33L and 33R expanded outwardly to the left and the right to positions more outside than the ear-hook sections 14L and 14R.

Next, the ear speaker device 1 is gradually lowered above a head 100 of the listener. In this manner, the headband 11 contacts with a head top section 100A. At this time, the tubular ducts 33L and 33R are kept expanded to the outward directions. In this manner, the tubular ducts 33L and 33R are at positions more outside than auricles 101L and 101R without interfering with the auricles 101L and 101R.

When force in outward directions applied to the speaker movable sections 25L and 25R is weakened at this stage, restoring force of the headband 11 biases the ear-hook sections 14L and 14R inwardly, that is, directions of arrows b2L and b2R. In this manner, the ear speaker device 1 sandwiches the head 100 of the listener from the left and right.

At this time, the ear speaker device 1 allows the listener to adjust positions of the hangers 13L and 13R with respect to the sliders 12L and 12R. In this manner, the ear-hook sections 14L and 14R contact with auricle base upper sections 101AL and 101AR of the listener.

In this case, the ear-hook section 14L does not only contact the auricle base upper section 101AL, but also is sandwiched between the head 100 and the auricle base upper section 101AL of the listener. Accordingly, a position of the ear-hook section 14L is held stably with respect to the head 100 in a similar manner as, for example, the bows temples of a pair of glasses. This also applies to the ear-hook section 14R.

In addition, when the ear-hook sections 14L and 14R are only biased in inward directions from the outside of the auricles 101L and 101R, the ear-hook sections 14L and 14R end up sandwiching the auricles 101L and 101R from the outside. Accordingly, at least in the vicinity of the auricles 101L and 101R, the ear-hook sections 14L and 14R are preferably lowered in a vertical direction in a manner sliding on a surface of the head 100.

Figure 8A:
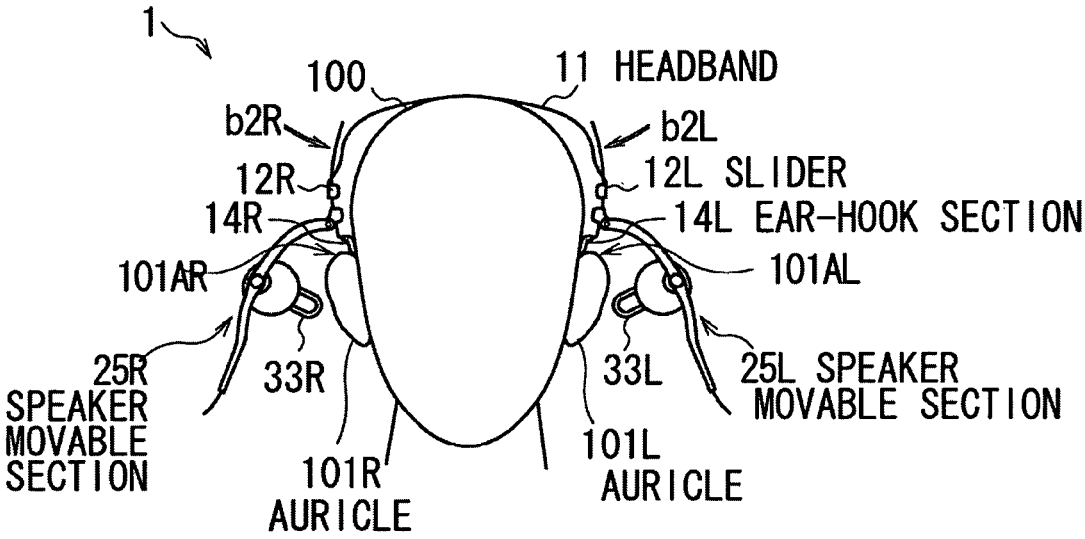
FIGS. 8A and 8B are schematic views used for explaining mounting (2) of the ear speaker device.
Figure 8B:
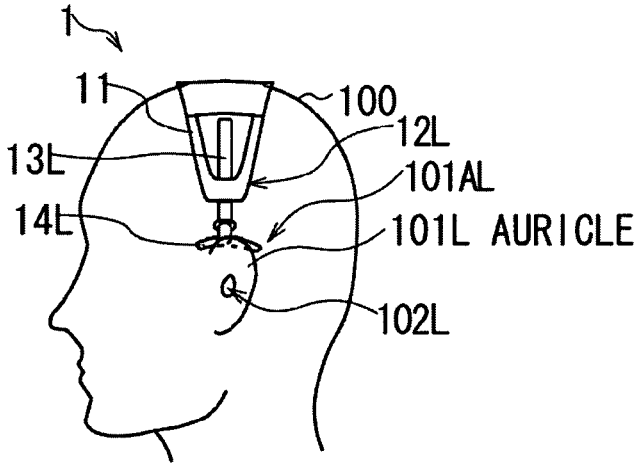

As a result, as shown in FIGS. 8A and 8B, the ear speaker device 1 stably mounts the headband 11, the hangers 13L and 13R, and the ear-hook sections 14L and 14R (that is, the mount section 10) on the head 100 of the listener.

In case the listener has already grasped proper positions of the hangers 13L and 13R by using marking of the scale and the numbers, the ear speaker device 1 allows the listener to adjust the positions of the hangers 13 and 13R with respect to the sliders 12L and 12R in advance. In this manner, the listener does not need to adjust the positions again after mounting the ear speaker device 1.

When the ear speaker device 1 is completely released from a state shown in FIGS. 8A and 8B in a manner that force to outward directions applied to the speaker movable sections 25L and 25R is further weakened, the speaker movable sections 25L and 25R are rotated in inward directions, that is, directions of arrows a2L and a2R, by the restoring force of the rotation sections 22L and 22R.

At this time, the rotation sections 22L and 22R rotate the speaker movable sections 25L and 25R to inner positions at the most, or until the tubular ducts 33L and 33R contact with sections neat the external acoustic meatus openings 102L and 102R of the listener.

Further, the ear speaker device 1 allows the listener to adjust positions of the holders 21L and 21R with respect to the hangers 13L and 13R. Also, the ear speaker device 1 allows the listener to finely adjust mounting positions of the ear-hook sections 14L and 14R (that is, the mount section 10) in a front-back direction.

Figure 9A:
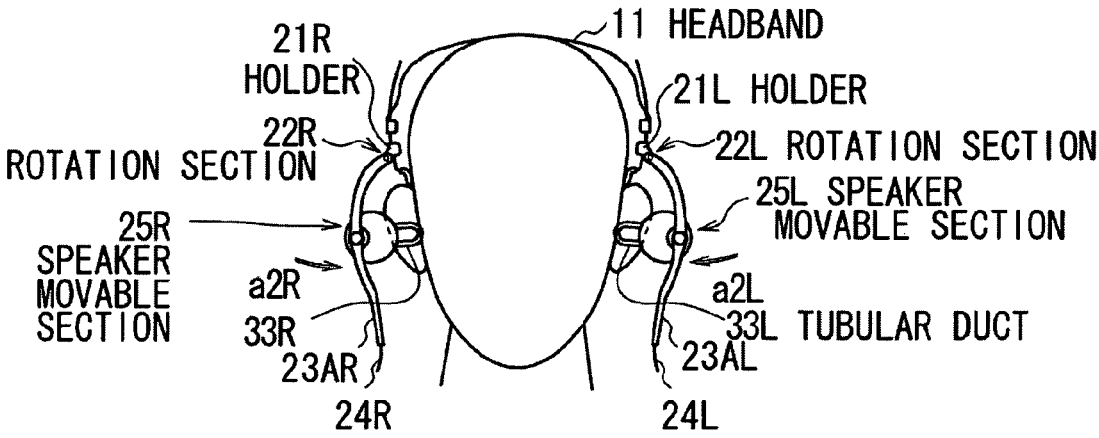
FIGS. 9A and 9B are schematic views used for explaining mounting (3) of the ear speaker device.
Figure 9B:
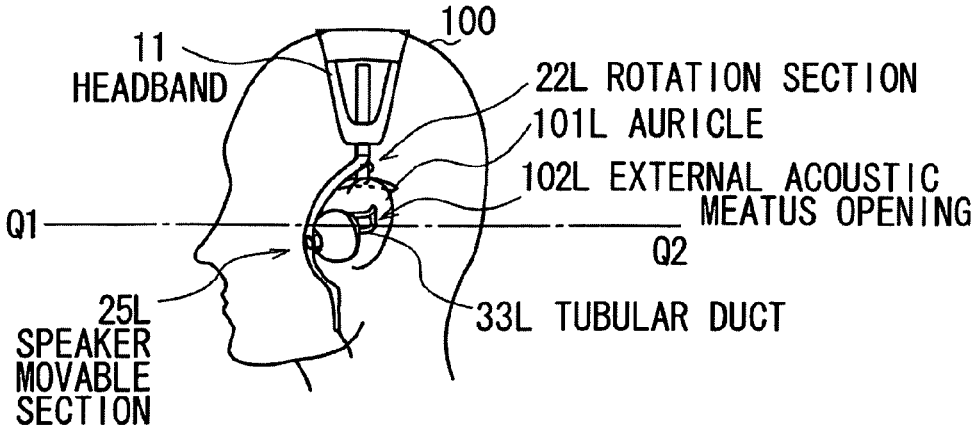

As a result, the ear speaker device 1 is mounted on the head 100 of the listener in a state where inner end sections of the tubular ducts 33L and 33R are slightly inside the external acoustic meatus openings 102L and 102R, as shown in FIGS. 9A and 9B.

In addition, the arms 23L and 23R are designed so that lower end sections are somewhat apart from cheeks of the listener when the arms 23L and 23R are mounted in the above manner. In this manner, the ear speaker device 1 can prevent the enclosures 31L and 31R of the speaker sections 30L and 30R, connection cables 24L and 24R from touching cheeks of the listener and causing uncomfortableness.

The ear speaker device 1 can be dismounted from a state where the ear speaker device 1 is mounted on the head 100 of the listener by following the steps of mounting in a reverse order. That is, the ear speaker device 1 is raised in the upward direction while the speaker movable sections 25L and 25R are expanded outwardly. In this manner, the ear speaker device 1 can be dismounted easily without causing the tubular ducts 33L and 33R to be interferences of the auricles 101L and 101R and the like.

As described above, the speaker movable sections 25L and 25R of the ear speaker device 1 are first rotated to the most outward positions and at the same time the headband 11 is also expanded in outward directions (FIGS. 7A and 7B). Next, when the ear speaker device 1 is lowered from above the head 100 of the listener, the ear-hook sections 14L and 14R are brought into contact with the auricle base upper sections 101AL and 101AR, respectively. In this manner, the mount section 10 is mounted on the head 100. Subsequently, by inwardly rotating the speaker movable sections 25L and 25R, the ear speaker device 1 is mounted in a state where the inner end sections of the tubular ducts 33L and 33R slightly enter the external acoustic meatus openings 102L and 102R.

(3) Acoustical Characteristic

When the ear speaker device 1 is properly mounted on the head 100 of the listener as shown in FIGS. 9A and 9B, the speaker section 30L is positioned somewhat forward of the auricle 101L on the head 100 of the listener. Here, shapes, attaching positions, attaching angles, and the like of the speaker section 30L and the arm 23L are adjusted so that a normal line of the sound emission surface 31AL is oriented to a direction of the external acoustic meatus opening 102L of the listener.

In this manner, the speaker section 30L of the ear speaker device 1 allows middle and high frequency sound emitted from the speaker unit 32L to directly reach the inside of the external acoustic meatus of the listener. Also, the speaker section 30L can allow reflected sound reflected on the cheek, the auricle 101L, and the like to reach the inside of the external acoustic meatus. In this manner, the ear speaker device 1 can provide natural sound image localization that is similar to one that is provided when sound is listened to by using a general floor type speaker.

Figure 10:
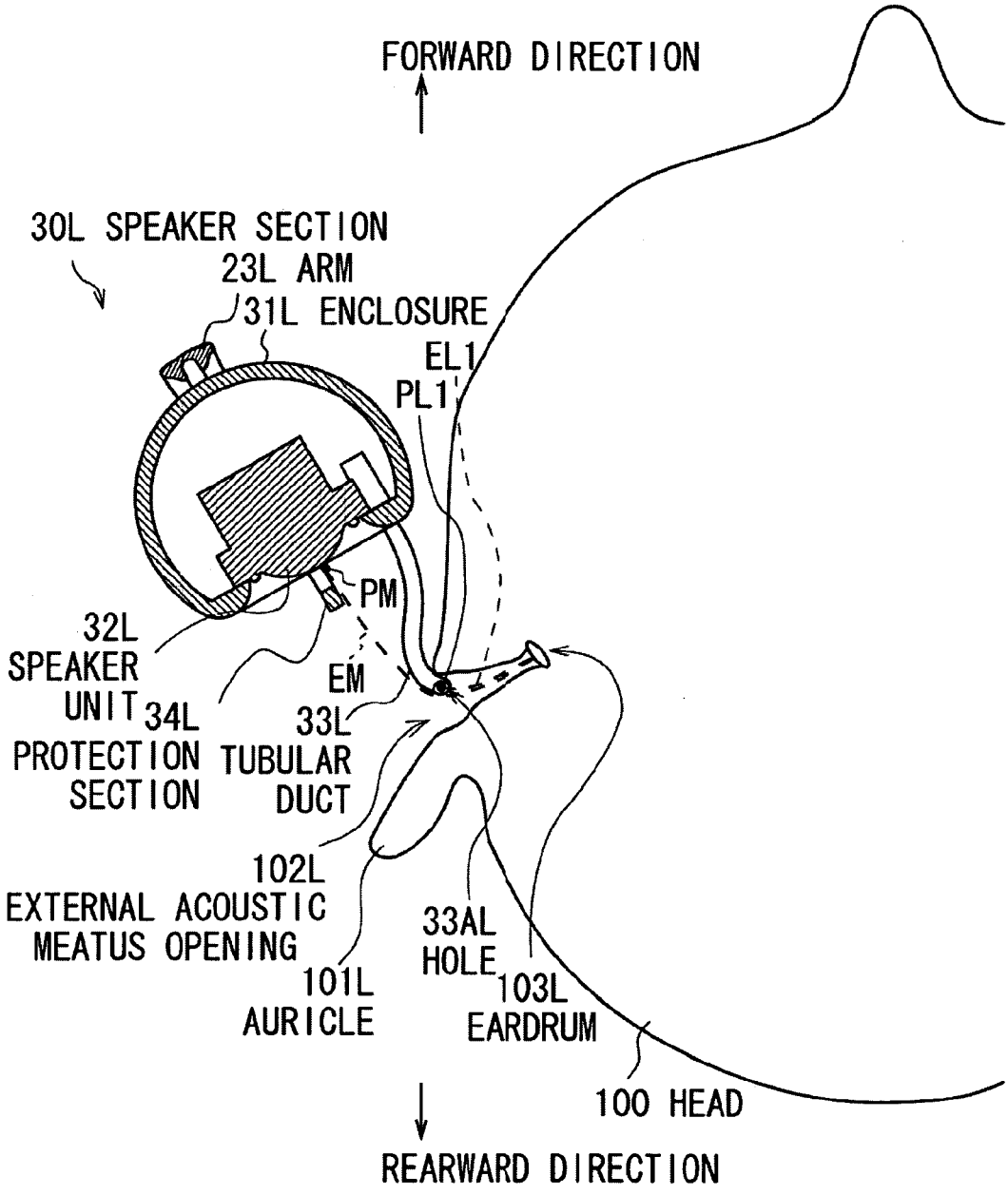
FIG. 10 is a schematic cross-sectional view used for explaining transmission of sound from the ear speaker device according to the present embodiment.

The enclosure 31L forms a substantially enclosed space in a state where the speaker unit 32L is attached as shown in FIG. 10 showing a cross section cut along the Q1-Q2 line in FIG. 9B. The enclosure 31L and the tubular duct 33L form a resonant circuit with respect to the speaker unit 32L.

Figure 11:
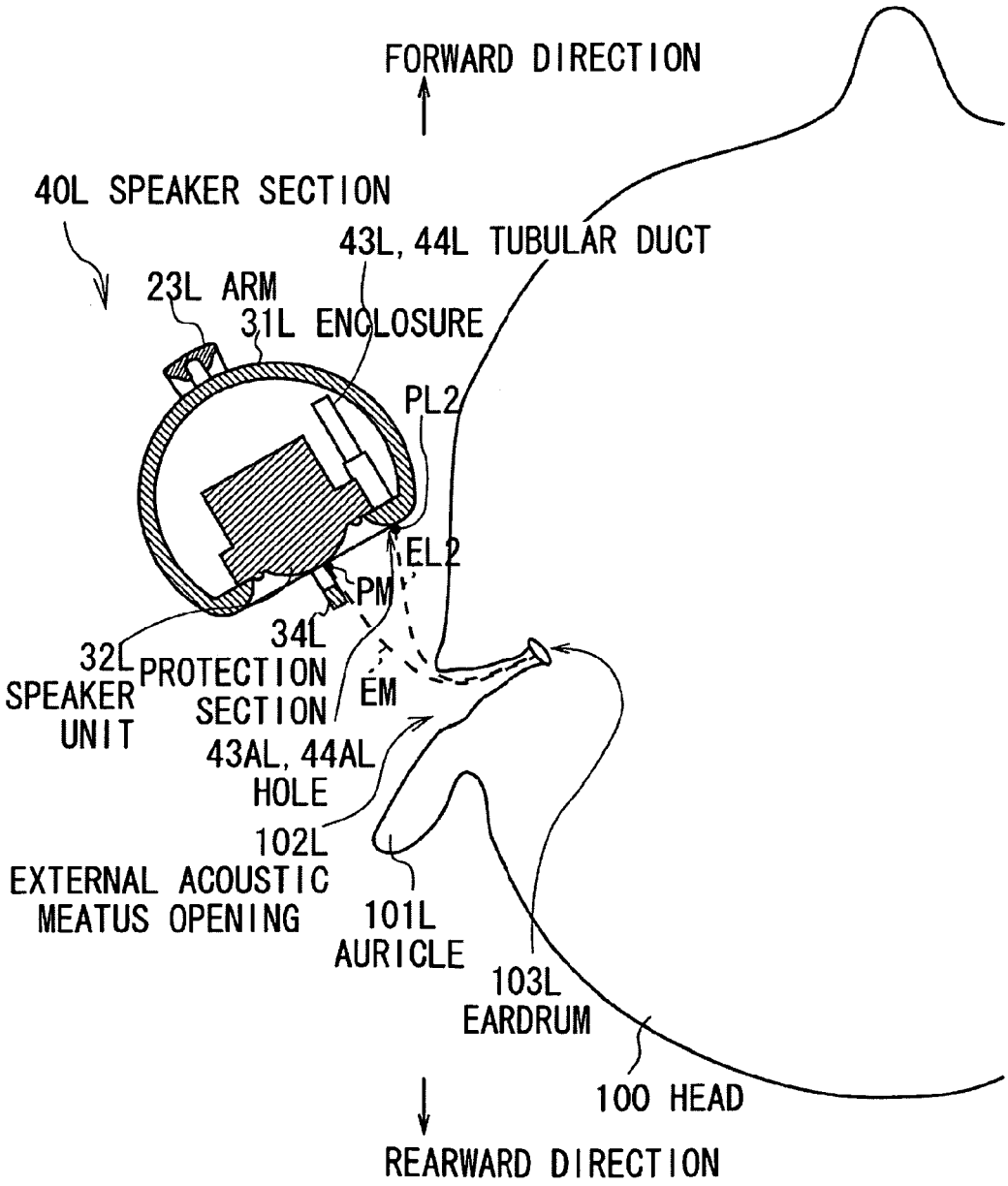
FIG. 11 is a schematic cross-sectional view used for explaining transmission of sound from a general bass-reflex type ear speaker device.

On the other hand, in a general bass-reflex type ear speaker device, a duct is provided only in the inside of the enclosure, and does not extend to the outside. In view of the above, for comparison with the speaker section 30L, a speaker section 40L as shown in FIG. 11, in which parts corresponding to those in FIG. 10 are denoted by the same reference numerals, is assumed.

The speaker section 40L (FIG. 11) has a structure which is similar to that of a general bass-reflex type speaker. The speaker section 40L includes two tubular ducts 43L and 44L only in an inner side of the enclosure 31L, in place of the tubular duct 33L (FIG. 10) of the speaker section 30L.

Here, when a sound emission position of the speaker unit 32L is assumed to be a position PM of an imaginary sound source (hereinafter referred to as the imaginary sound source position), middle and high frequency sound emitted from the speaker unit 32L reaches an ear drum 103L of the listener in a path length EM. In addition, when holes 43AL and 44AL are assumed to be at an imaginary sound source position PL2, low frequency sound emitted from the holes 43AL and 44AL after passing through the tubular ducts 43L and 44L reaches the ear drum 103L of the listener in a path length EL2. In this case, a relationship, that is the path length EM≈the path length EL2, is established.

Figure 12:
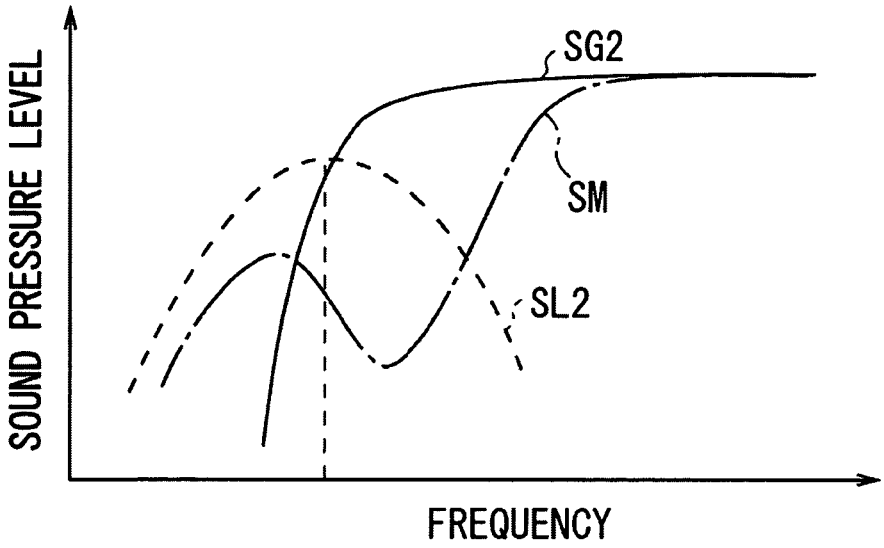
FIG. 12 is a schematic view showing a frequency characteristic of the general bass-reflex type ear speaker device.

A frequency characteristic of sound that reaches the ear drum 103L from the speaker section 40L is as shown in FIG. 12. As shown in FIG. 12, the general bass-reflex type speaker section 40L allows a combination of middle and high frequency sound and low frequency sound to reach the ear drum 103L of the listener. The middle and high frequency sound is emitted from the speaker unit 32L and has a frequency characteristic as shown by a characteristic curve SM. The low frequency sound is emitted from the holes 43AL and 44AL after passing through the tubular ducts 43L and 44L and has a frequency characteristic as shown in a characteristic curve SL2.

In the above manner, the listener can listen to the reproduction sound in which a sound pressure level in low frequency sound range in the characteristic curve SM as shown by a characteristic curve SG2 obtained by combining the characteristic curve SM and the characteristic curve SL2 by the speaker section 40L.

On the other hand, with respect to the speaker section 30L (FIG. 10) as well, when the speaker unit 32L is assumed to be the imaginary sound source position PM, middle and high frequency sound emitted from the speaker unit 32L reaches the ear drum 103L of the listener in a path length EM. In addition, when the holes 33AL are assumed to be at the imaginary sound source position PL1, low frequency sound emitted from the hole 33AL after passing through the tubular duct 33L reaches the ear drum 103L of the listener in a path length EL1. In case of the speaker section 30L, a relationship is established, that is, path length EM>path length EL1.

Figure 13:
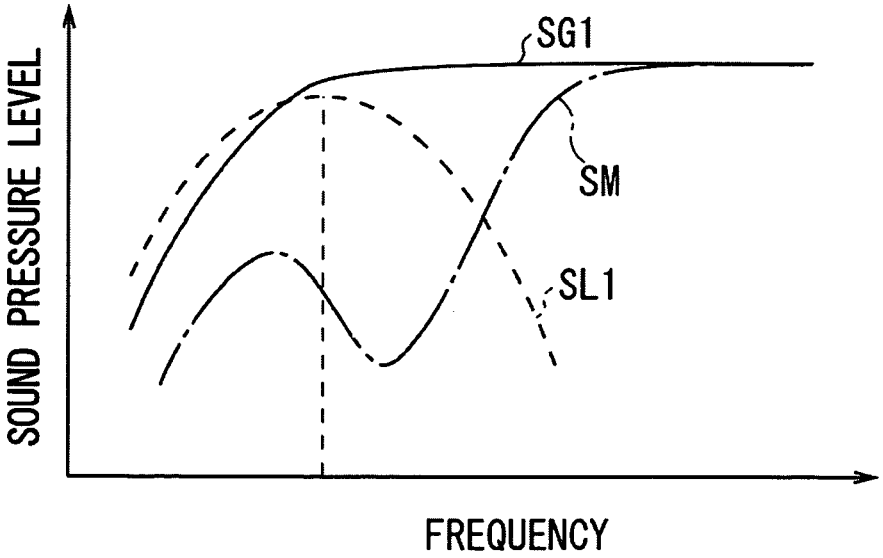
FIG. 13 is a schematic view showing a frequency characteristic of the ear speaker device according to the present invention.

A frequency characteristic of sound that reaches the ear drum 103L from the speaker section 30L is shown in FIG. 13. As described above, the speaker section 30L is a type of a bass-reflex type speaker. Accordingly, as similar to the case shown in FIG. 12, the speaker section 30L allows middle and high frequency sound and low frequency sound to reach the ear drum 103L of the listener. The middle and high frequency sound is emitted from the speaker unit 32L and has a frequency characteristic as shown by the characteristic curve SM. The low frequency sound is emitted from the hole 33AL after passing through the tubular duct 33L and has a frequency characteristic as shown in the characteristic curve SL1.

Generally, a distance from a sound source is inverse proportion to a sound pressure level. Here, when path lengths of the speaker section 30L (FIG. 10) and the speaker section 40L (FIG. 11) are compared, a relationship of path length EL1<path length EL2 is obtained.

That is, the speaker section 30L (FIG. 10) can allow low frequency sound emitted from the hole 33AL (imaginary sound source position PL1) after passing through the tubular duct 33L to reach the ear drum 103L with a high sound pressure level than that in case of the speaker section 40L. This is because the imaginary sound source position PL1 is positioned closer to the vicinity of the external acoustic meatus opening 102L of the listener than the imaginary sound source position PL2 of the speaker section 40L (FIG. 11).

Figure 14:
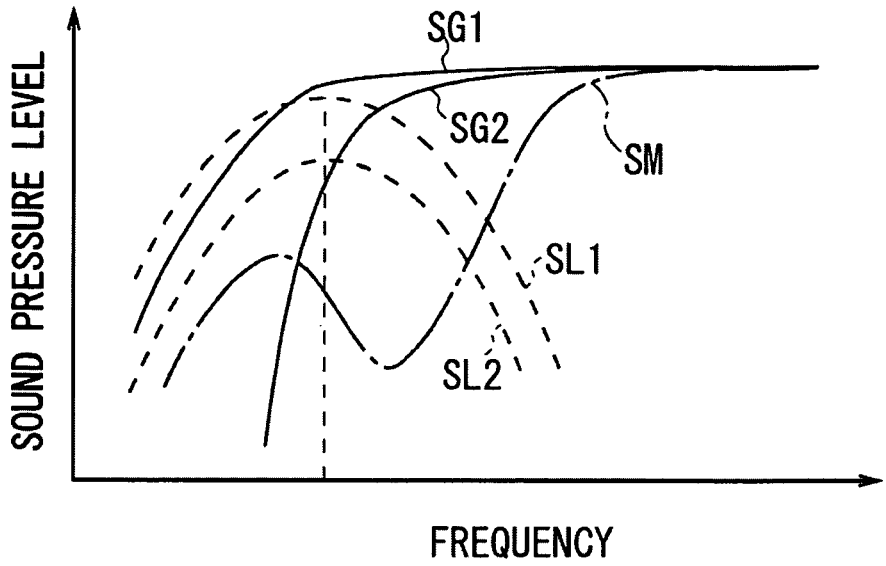
FIG. 14 is a schematic view showing a theoretical frequency characteristic.

In this manner, with respect to the speaker section 30L (FIG. 10), the characteristic curve SL1 of low frequency sound by the tubular duct 33L has an entire sound pressure level that is high in comparison with the characteristic curve SL2 of low frequency sound by the tubular ducts 43L and 44L, due to the relationship of path length EL1<path length EL2, as shown in FIG. 14 that combines two curves, i.e., the characteristic curves SL1 and SL2.

As a result, the speaker section 30L can allow the listener to listen to the reproduction sound of a sufficient sound pressure level up to a comparatively low frequency band that is made higher than a sound pressure level in low frequency sound in the characteristic curve SM (characteristic curve SG2) in the case of the speaker section 40L, as shown in the characteristic curve SG1 obtained by combining the characteristic curve SM and the characteristic curve SL1.

Here, the characteristic curve SG1 and the characteristic curve SG2 are compared. In the comparison, while a sound pressure level becomes lower comparatively rapidly on a low frequency sound range side in the characteristic curve SG2, degree of lowering of a sound pressure level on the low frequency sound side is moderate in the characteristic curve SG1.

That is, the speaker section 30L can allow the listener to listen to the excellent reproduction sound including a high sound pressure level in a wide frequency band as compared with the speaker section 40L, that is, including sufficient low frequency sound range, which is transmitted to the ear drums 103 of the listener.

In this case, the speaker section 30L does not completely block the external acoustic meatus opening 102L although an inner end section of the tubular duct 33L is positioned in the vicinity of the external acoustic meatus opening 102L of the listener, as shown in FIGS. 9B and 10.

For this reason, the speaker section 30L can allow the listener to listen to sound (hereinafter referred to as the surrounding sound) generated around the listener which is made reaching the ear drum 103L of the listener without being blocked by the speaker section 30L, in addition to the reproduction sound obtained by combining middle and high frequency sound emitted from the speaker unit 32L and low frequency sound emitted from the hole 33AL of the tubular duct 33L.

In addition, the hole 33AL is provided in a manner oriented to a rear side of the listener, not to the ear drum 103L of the listener, as shown in FIG. 10. In this manner, the speaker section 30L can prevent middle and high frequency sound slightly leaking from the hole 33AL of the tubular duct 33L from directly reaching the ear drum 103L. In this manner, the sound quality is improved.

With respect to the speaker section 30L (FIG. 10) and the speaker section 40L (FIG. 11), an actual frequency characteristic was measured by using a measurement tool that imitates the auricle and the external acoustic meatus of a human being. As a result, a characteristic curve SG11 (in case of the speaker section 30L) and a characteristic curve SG12 (in case of the speaker section 40L) as shown in FIG. 15 were obtained.

Figure 15:
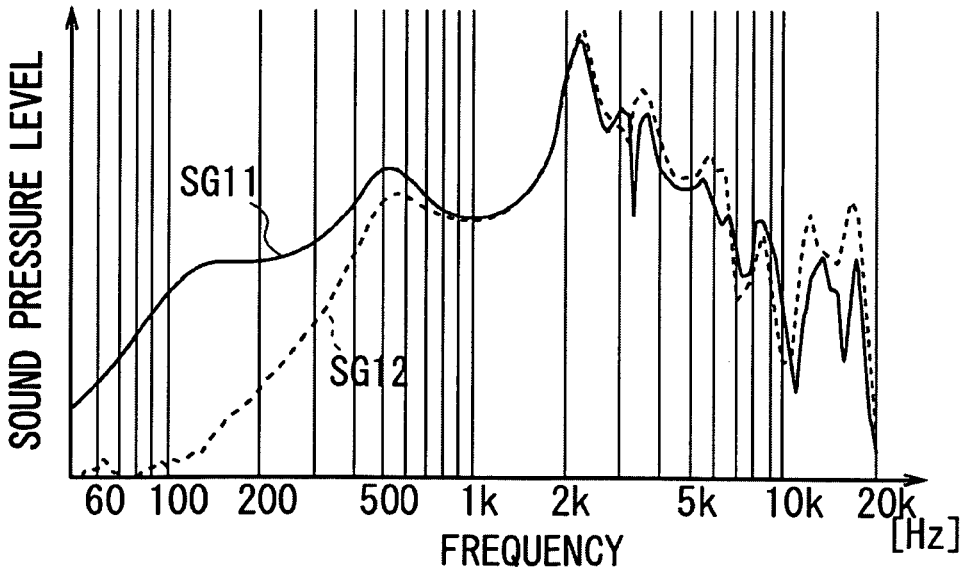
FIG. 15 is a schematic view showing a frequency characteristic by actual measurement.

In FIG. 15, the characteristic curve SG11 of the speaker section 30L has a sound pressure level which is higher than that of the characteristic curve SG12 of the speaker section 40L in low frequency sound of about 500 Hz or lower, in a similar manner as theoretical frequency characteristics shown in FIG. 14. That is, FIG. 15 shows that the speaker section 30L can actually allow the listener to listen to the excellent reproduction sound that includes sufficient low frequency sound.

As described above, when the ear speaker device 1 is mounted on the head 100 of listener, the speaker unit 32L is positioned at a location somewhat apart from the external acoustic meatus opening 102L of the listener, and the speaker unit 32L emits middle and high frequency sound of the reproduction sound. At the same time, low frequency sound of the reproduction sound is emitted from the hole 33AL of the tubular duct 33L that is extended to the vicinity of the external acoustic meatus opening 102L from the enclosure 31L. In this manner, the ear speaker device 1 can allow the listener to listen to the excellent reproduction sound including sufficient low frequency sound while providing natural sound image localization.

(4) Operation and Advantageous Effect

In the above structure, the ear speaker device 1 can make the mount section 10 contacts with the head of the listener by the headband 11 and the ear-hook sections 14L and 14R. In addition, the speaker movable sections 25L and 25R can be rotated outwardly with respect to the mount section 10 by the rotation sections 22L and 22R.

When the ear speaker device 1 is mounted on the head 100 of the listener, the speaker movable sections 25L and 25R are first expanded in outward directions. In this manner, the speaker movable sections 25L and 25R are rotated to the most outward positions. Further, the headband 11 is expanded in outward directions (FIGS. 7A and 7B).

Next, when the ear speaker device 1 is lowered from above the head 100 of the listener, the headband 11 is made contact with the top head section 100A while the tubular ducts 33L and 33R do not interfere with the auricles 101L and 101R.

Then, when force in outward directions applied to the speaker movable sections 25L and 25R is weakened, the ear-hook sections 14L and 14R are brought into contact with the auricle base upper sections 101AL and 101AR by the restoring force of the headband 11, and sandwich the head 100 from the left and right. In this manner, the ear speaker device 1 has the mount section 10 mounted on the head 100 (FIGS. 8A and 8B).

Further, when the force in outward directions applied to the speaker movable sections 25L and 25R is released, the ear speaker device 1 has the speaker movable sections 25L and 25R rotated inwardly by the restoring force of the rotation sections 22L and 22R. In this manner, the tubular ducts 33L and 33R are positioned near the external acoustic meatus openings 102L and 102R, respectively (FIGS. 9A and 9B).

Therefore, the ear speaker device 1 can be easily and stably mounted on the head 100 of the listener, regardless of the tubular ducts 33L and 33R are positioned at locations more inside than those of the ear-hook sections 14L and 14R in a natural state so as to correspond to the shape of the ear of the listener.

At this time, the ear speaker device 1 can be mounted on or dismounted from the head 100 in a manner that the speaker movable sections 25L and 25R on the left and right are expanded outwardly temporarily and then released when the speaker movable section 25L and 25R are mounted or dismounted. This operation is similar to one that is carried out with respect to a general headphone device including a headband. For this reason, with respect to mounting or dismounting of the ear speaker device 1, the listener does not need to carry out or learn special operation. Accordingly, the ear speaker device 1 does not cause troublesomeness.

In addition, when the ear speaker device 1 is mounted on the head 100 of the listener, the ear-hook sections 14L and 14R can apply a comparatively strong bias in inward directions from the left and right by the restoring force of the headband 11 to the head 100.

At this time, even if the tubular ducts 33L and 33R are in contact with the vicinity of the external acoustic meatus openings 102L and 102R of the listener, the rotation sections 22L and 22R applied with comparatively weak rotational force can release the tubular ducts 33L and 33R in outward directions. Accordingly, the ear speaker device 1 can prevent causing pain and uncomfortableness by strongly pressing the tubular ducts 33L and 33R near the external acoustic meatus openings 102L and 102R of the listener.

For the above reason, the ear speaker device 1 can stably mount the mount section 10 on the head 100 by using the ear-hook sections 14L and 14R. At the same time, the ear speaker device 1 can bring the tubular ducts 33L and 33R lightly into contact with the vicinity of the external acoustic meatus openings 102L and 102R. In this manner, positions of the speaker units 32L and 32R and the holes 33AL and 33AR can be stabilized.

In addition, in general, spaces between the auricle base upper sections 101AL and 101AR and the external acoustic meatus openings 102L and 102R are different depending on the listeners. With respect to this point, the ear speaker device 1 can adjust the holders 21L and 21R with respect to the hangers 13L and 13R in a vertical direction. Accordingly, the ear speaker device 1 can allow each listener to adjust the tubular ducts 33L and 33R to be at optimal positions in the vicinity of the external acoustic meatus openings 102L and 102R.

As a result, the ear speaker device 1 can provide natural sound image localization to the listener from the speaker sections 30L and 30R. At the same time, the ear speaker device 1 can allow the listener to listen to the excellent reproduction sound including sufficient low frequency sound.

In addition, the holders 21L and 21R sandwich the hangers 13L and 13R from the front and back sides of the hangers with the force that is stronger than that of the sliders 12L and 12R. For the above reason, the ear speaker device 1 can maintain positions of the holders 21L and 21R with respect to the hangers 13L and 13R, even in case, for example, external force is applied to the speaker movable sections 25L and 25R so as to move the sliders 12L and 12R to bottom ends of the hangers 13L and 13R when the ear speaker device 1 is stored, and the sliders 12L and 12R are put back to original positions when the ear speaker device 1 is mounted.

Further, the arms 23L and 23R not only extend from the rotation sections 22L and 22R to the speaker sections 30L and 30R, but also allow the listener to hold the speaker movable sections 25L and 25R easily since the arms 23L and 23R extend to positions lower than the speaker sections 30L and 30R.

At this time, the speaker sections 30L and 30R protect the speaker units 32L and 32R by using the protection sections 34L and 34R. Accordingly, sound emission surfaces of the speaker units 32L and 32R are released as much as possible to minimize the lowering of sound quality. At the same time, the protection sections 34L and 34R prevent the listener from accidentally touching the speaker units 32L and 32R and also damaging the speaker units 32L and 32R by applying force, when the listener holds the speaker movable sections 25L and 25R in a groping manner.

According to the configuration described above, the ear speaker device 1 includes the mount section 10 that is provided with the ear-hook sections 14L and 14R, and the rotation sections 22L and 22R that rotate the speaker movable sections 25L and 25R with respect to the mount section 10. The tubular ducts 33L and 33R are positioned more inside than the ear-hook sections 14L and 14R in a natural state. When the ear speaker device 1 is mounted on the head 100 of the listener, the speaker movable sections 25L and 25R are rotated to the most outside positions. Then, the ear speaker device 1 is lowered and the ear-hook sections 14L and 14R are brought into contact with the auricle base upper sections 101AL and 101AR, respectively. Next, force in outward directions applied to the speaker movable sections 25L and 25R is released, and the speaker movable sections 25L and 25R are rotated inwardly by the elastic force of the rotation sections 22L and 22R. In this manner, the ear speaker device 1 can be mounted on the head 100 of the listener so as to position the tubular ducts 33L and 33R in the vicinity of the external acoustic meatus openings 102L and 102R, respectively, of the listener without interfering with the auricles 101L and 101R, and the like.

(5) Other Embodiments

In the embodiment described above, the description has been made with respect to the case where the rotation sections 22L and 22R rotate the arms 23L and 23R in outward directions with respect to the holders 21L and 21R around the rotational axis XL extending in the front-back direction. However, the present invention is not limited thereto, and a direction of a rotational axis may be arbitrarily set in a manner, for example, the rotation sections 22L and 22R rotate the arms 23L and 23R in front outward directions or rear outward directions with respect to the holders 21L and 21R around a rotational axis extending in a vertical direction.

Alternatively, the speaker sections 30L and 30R may be expanded in outward directions by bending of the arms 23L and 23R themselves. What is important here is that the speaker sections 30L and 30R are supported so as to position inner end sections of the tubular ducts 33L and 33R in the vicinity of the external acoustic meatus openings 102L and 102R of the listener in a state where the ear speaker device 1 is mounted on the head 100 of the listener. Then, when the ear speaker device 1 is mounted to or dismounted from the head 100 of the listener, the tubular ducts 33L and 33R are to be in a state of not interfering with the auricles 101L and 101R.

In addition, in the embodiment described above, the description has been made with respect to the case where the tubular ducts 33L and 33R are made of aluminum. However, the present invention is not limited thereto, and the tubular ducts 33L and 33R may be made of a flexible resin material. In this manner, when the ear speaker device 1 is mounted on or dismounted from the head 100 of the listener, interference with the auricles 101L and 101R and the like is prevented.

In addition, in the embodiment described above, the description has been made with respect to the case where the holders 21L and 21R are slid on the hangers 13L and 13R so as to allow the listener to adjust the spaces between the ear-hook sections 14L and 14R and inner end sections of the tubular ducts 33L and 33R. However, the present invention is not limited thereto, and the spaces may be adjusted by changing attaching positions of the speaker sections 30L and 30R on the arms 23L and 23R.

Further, in the embodiment described above, the description has been made with respect to the case where the arms 23L and 23R are formed in a substantial arc shape. However, the present invention is not limited thereto, and the arms 23L and 23R may have a variety of shapes, such as a V-shape and a curved surface shape.

Further, in the embodiment described above, the description has been made with respect to the case where the connection cables 24L and 24R are pulled out from the bottom ends of the arms 23L and 23R. However, the present invention is not limited thereto, and, for example, the connection cables 24L and 24R may be pulled out from the bottom surfaces of the speaker sections 30L and 30R.

Further, in the embodiment described above, the description has been made with respect to the case where the protection sections 34L and 34R are provided so as to form part of rim sections of circular plates of the sound emission surfaces 31AL and 31AR of the speaker sections 30L and 30R. However, the present invention is not limited thereto, and the protection sections 34L and 34R may have other variety of shapes. What is important here is that the protection sections 34L and 34R do not block sound emitted from the speaker units 32L and 32R as much as possible, and protect diaphragms and the like of the speaker units 32L and 32R from contact. In addition, the protection sections 34L and 34R may be omitted.

Further, in the embodiment described above, the description has been made with respect to the case where the ear-hook sections 14L and 14R are formed in a substantial crescent shape. However, the present invention is not limited thereto, and the ear-hook sections 14L and 14R may have a variety of shapes, such as a linear shape or a shape along the base of the auricle. What is important here is that the ear-hook sections 14L and 14R have a shape that allows the mount section 10 to be stably mounted on the head 100 of the listener.

Further, in the embodiment described above, the description has been made with respect to the case where the listener is allowed to adjust the length of the mount section by sliding the hangers 13L and 13R on the sliders 12L and 12R in vertical directions. However, the present invention is not limited thereto, and the listener may be allowed to adjust the length of the mount section by incorporating an adjusting mechanism in the headband 11, for example.

The present invention may be applied to an ear speaker device, a headphone device, and the like that are mounted on the head of the listener and allows the listener to listen to the reproduction sound.

It should be understood by those skilled in the art that various modifications, combinations, sub-combinations and alterations may occur depending on design requirements and other factors insofar as they are within the scope of the appended claims or the equivalents thereof.

What is claimed is:

1. An ear speaker device, comprising:

a mount section to be mounted on a head of a listener in a manner contacting an upper part of the head, and a left auricle base upper section and a right auricle base upper section of the listener;

a left speaker section and a right speaker section, each comprising a hollow enclosure to which a speaker unit is attached;

a left support section and a right support section attached to the mount section to support the speaker section and the right speaker section respectively, so as to position a sound emission surface of the speaker unit of each of the left speaker section and the right speaker section in front of a left external acoustic meatus opening and a right external acoustic meatus opening respectively, of the listener; and a left tubular duct and a right tubular duct attached to the hollow enclosure of the left speaker section and the right speaker section respectively, and extended so as to allow sound generated in the hollow enclosure of the left speaker section and the right speaker section to reach the vicinity of the left external acoustic meatus opening and the right external meatus opening respectively.

2. The ear speaker device according to claim 1, wherein the mount section comprises a left ear-hook section and a right ear-hook section that contact the left auricle base upper section and the right auricle base upper section respectively, of the listener.

3. The ear speaker device according to claim 1, wherein each of the left support section and the right support section comprises a holder attached to the mount section, an arm to which the respective left speaker section and the right speaker section is attached, and a rotation section that freely rotates the arm within a predetermined rotation range with respect to the holder around a rotational axis connecting a front-back direction of the listener.

4. The ear speaker device according to claim 3, wherein the left support section and the right support section transmit force in outward direction on the left and right that is applied to the arm in a state where the arm has reached a maximum rotation position in the outward direction on the left and right to the mount section.

5. The ear speaker device according to claim 3, wherein the rotation section biases the holder so as to rotate the arm in an inward direction on the left and right.

6. The ear speaker device according to claim 5, wherein the arm comprises a cable that supply a sound signal to the speaker unit extending from a bottom end of the arm.

7. The ear speaker device according to claim 3, wherein attaching position of the holder with respect to the mount section is adjustable in a vertical direction.

8. The ear speaker device according to claim 3, wherein the mount section comprises a headband that contacts the upper part of the head, a left hanger and a right hanger attached to the headband, and a left slider and a right slider that allow the left hanger and the right hanger to slide in a vertical direction with respect to the headband.

9. The ear speaker device according to claim 8, wherein the holder of the left support section and the right support section is attached to the left hanger and the right hanger respectively, so as to be able to slide in the vertical direction.

10. The ear speaker device according to claim 1, wherein the left tubular duct and the right tubular duct are formed in a substantial U-shape, in which the left tubular duct and the right tubular duct extend from the hollow enclosure of the left speaker section and the right speaker section respectively, to the vicinity of the left external acoustic meatus opening and the right external acoustic meatus opening respectively, of the listener and then return to the hollow enclosure again, and each of the left tubular duct and the right tubular duct are provided with a hole to emit sound in the vicinity of the left external acoustic meatus opening and the right external acoustic meatus opening respectively, of the listener.

11. The ear speaker device according to claim 1, further comprising a left protection section and a right protection section, each comprising an arced rim section having an outside diameter substantially similar to that of the hollow enclosure of the left speaker section and the right speaker section respectively, and each coupled to the hollow enclosure substantially perpendicularly.

12. The ear speaker device according to claim 1, wherein the left support section and the right support section temporarily position the left speaker section and the right speaker section outwards to the mount section when force in an outward direction on the left and right is applied to the left support section and the right support section respectively, and position the left speaker section and the right speaker section in front of the left external acoustic meatus opening and right external acoustic meatus opening respectively, with respect to the mount section when the force in the outward directions is released.

13. The ear speaker device according to claim 1, wherein the left support section and the right support section position an inner end section of the left tubular duct and the right tubular duct respectively, to a position outwards to a left ear-hook section and a right ear-hook section of the mount section respectively, when force in an outward direction on the left and right is applied to the left support section and the right support section respectively.

14. The ear speaker device according to claim 1, wherein a bottom end of an arm of the left support section and a bottom end of an arm of the right support section are apart from the listener for a predetermined space when the ear speaker device is mounted on the head of the listener.

15. The ear speaker device according to claim 9, wherein a first fixed strength of the holder with respect to one of the left hanger or the right hanger is stronger than a second fixed strength between the one of the left hanger or the right hanger and one of the left slider or the right slider.

* * * * *